US012428825B2

(12) United States Patent
Mueller

(10) Patent No.: US 12,428,825 B2
(45) Date of Patent: Sep. 30, 2025

(54) DRAIN FITTING AND INSTALLATION METHODS

(71) Applicant: Daniel Mueller, Strawn, IL (US)

(72) Inventor: Daniel Mueller, Strawn, IL (US)

( * ) Notice: Subject to any disclaimer, the term of this patent is extended or adjusted under 35 U.S.C. 154(b) by 0 days.

(21) Appl. No.: 18/886,282

(22) Filed: Sep. 16, 2024

(65) Prior Publication Data

US 2025/0270799 A1 Aug. 28, 2025

Related U.S. Application Data

(63) Continuation of application No. 18/584,771, filed on Feb. 22, 2024.

(51) Int. Cl.
*E03F 5/04* (2006.01)
*E03C 1/20* (2006.01)

(52) U.S. Cl.
CPC ..... *E03C 1/20* (2013.01); *E03F 5/0407* (2013.01); *Y10T 137/6988* (2015.04)

(58) Field of Classification Search
CPC ..... E03F 5/0407; Y10T 137/6988
See application file for complete search history.

(56) References Cited

U.S. PATENT DOCUMENTS

| | | | | |
|---|---|---|---|---|
| 2,749,999 | A * | 6/1956 | Schmid | E03F 5/0409 285/31 |
| 3,674,149 | A * | 7/1972 | Donalson | E03F 5/0407 210/163 |
| 4,910,811 | A * | 3/1990 | Izzi, Sr. | E03C 1/262 210/163 |
| 4,943,100 | A * | 7/1990 | Emberson | E03F 5/0409 210/164 |
| 11,359,362 | B2 * | 6/2022 | Boeltl | E03F 5/0407 |

* cited by examiner

*Primary Examiner* — Kevin F Murphy
(74) *Attorney, Agent, or Firm* — The Law Offices of Konrad Sherinian, LLC; Jeffrey S. Dixon

(57) ABSTRACT

A one-piece drain fitting with an integral mounting flange. The mounting flange has a plurality of holes for quickly securing the mounting flange to the top or bottom side of a wood sub-floor with screws or nails. The drain fitting can alternatively be installed in pre-cast or cast-in-place concrete without the use of fasteners. The drain fitting can be provided with a removable temporary cover for keeping out debris during construction.

20 Claims, 3 Drawing Sheets

DRAIN FITTING AND INSTALLATION METHODS

CROSS-REFERENCE

This application is a continuation of U.S. patent application Ser. No. 18/584,771, filed Feb. 22, 2024 and entitled DRAIN FITTING AND INSTALLATION METHODS, the entirety of which is hereby incorporated herein for all purposes.

FIELD OF THE DISCLOSURE

The present disclosure relates to a floor drain fitting. More particularly, it relates to a one-piece floor drain fitting for an open-site floor drain within a building and methods of installing the floor drain fitting in a floor.

SUMMARY

According to an aspect of the disclosure, a drain fitting comprises a drain body of one-piece construction. The drain body has a top side, a top opening on the top side, a bottom side opposite the top side, a bottom opening on the bottom side, an outer periphery, an inner periphery, an axis extending vertically through the top opening and the bottom opening, and a peripherally enclosed flow channel extending vertically from the top opening to the bottom opening and radially outwardly from the axis to the inner periphery. The drain body comprises a drain cup, a hub connection, and a peripheral mounting flange. The drain cup comprises a cup sidewall and a cup floor, the cup sidewall extending circumferentially around the flow channel and having an upper end circumscribing the top opening, the cup floor being connected to a lower end of the cup sidewall. The hub connection comprising a hub sidewall connected to a bottom side of the cup floor, the hub sidewall extending circumferentially around the flow channel, a lower end of the hub sidewall circumscribing the bottom opening. The mounting flange is connected to and extends radially outwardly from and circumferentially around the cup sidewall. The mounting flange comprises a plurality of fastener holes extending through a vertical thickness of the mounting flange, the mounting flange fastener holes being spaced radially outwardly from the cup sidewall and radially outwardly from the hub sidewall.

BRIEF DESCRIPTION OF THE DRAWINGS

Although the characteristic features of this disclosure will be particularly pointed out in the claims, the disclosed method and system, and how it may be made and used, may be better understood by referring to the following description taken in connection with the accompanying drawings forming a part hereof, wherein like reference numerals refer to like parts throughout the several views and in which:

Figure 2:
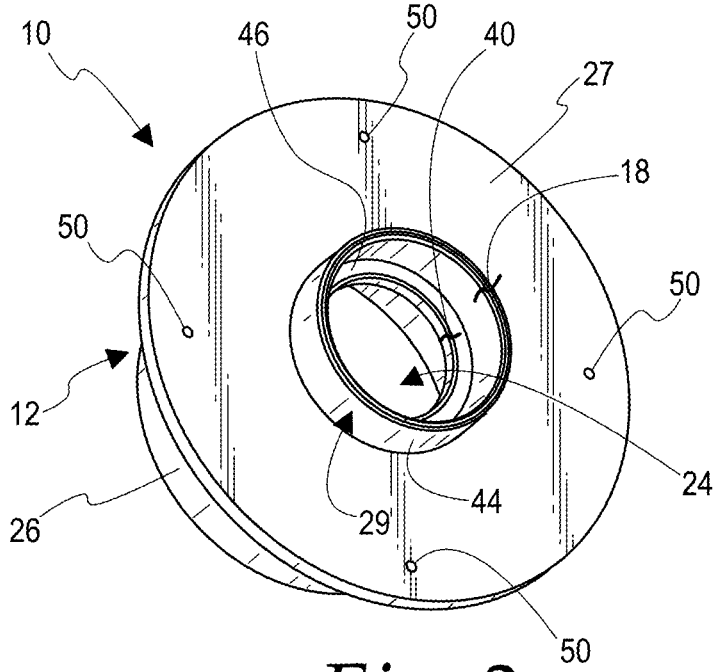
FIG. 2 is a bottom-lateral perspective view of the drain fitting of FIG. 1.
Figure 1:
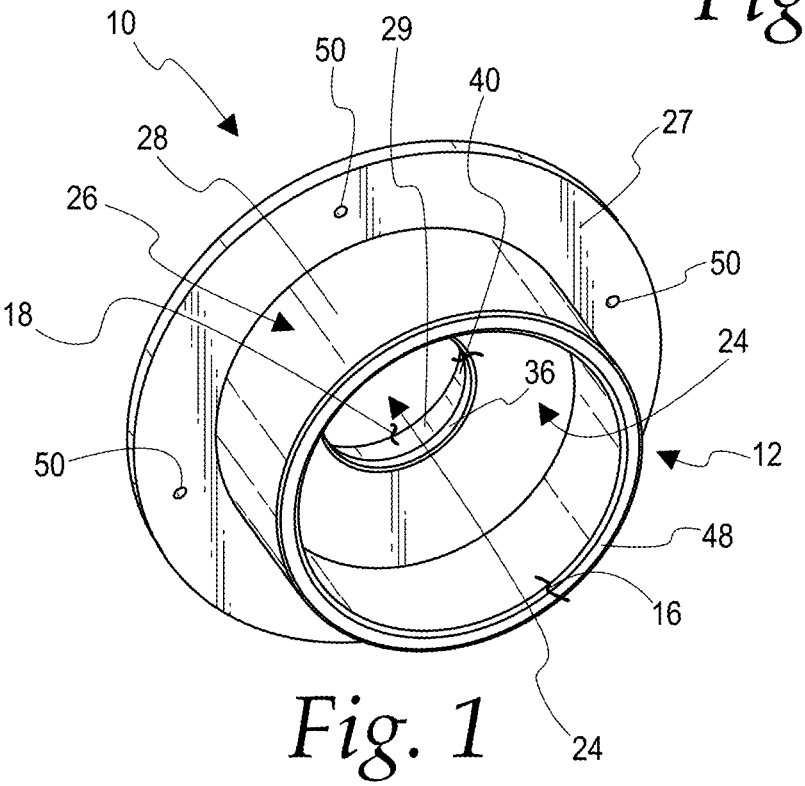
FIG. 1 is a top-lateral perspective view of a drain fitting according to an embodiment.
Figure 3:
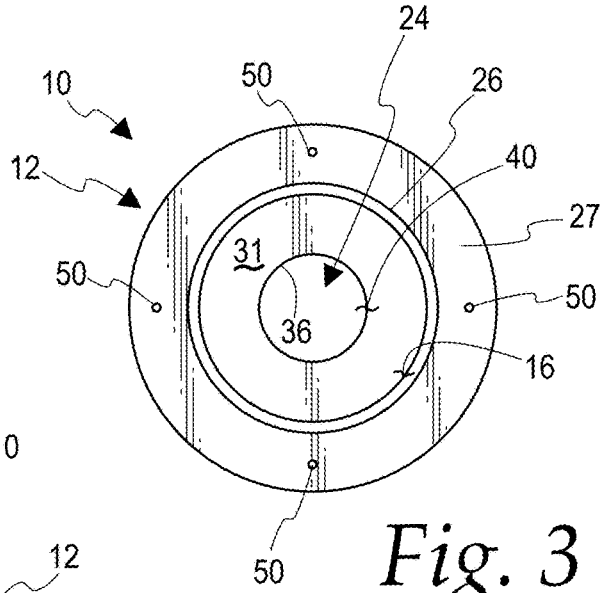
FIG. 3 is a top plan view of the drain fitting of FIG. 1.
Figure 4:
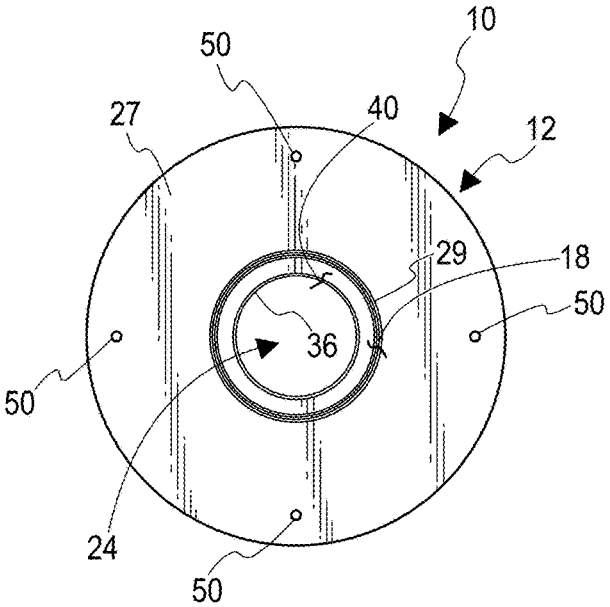
FIG. 4 is a bottom plan view of the drain fitting of FIG. 1.
Figure 5:
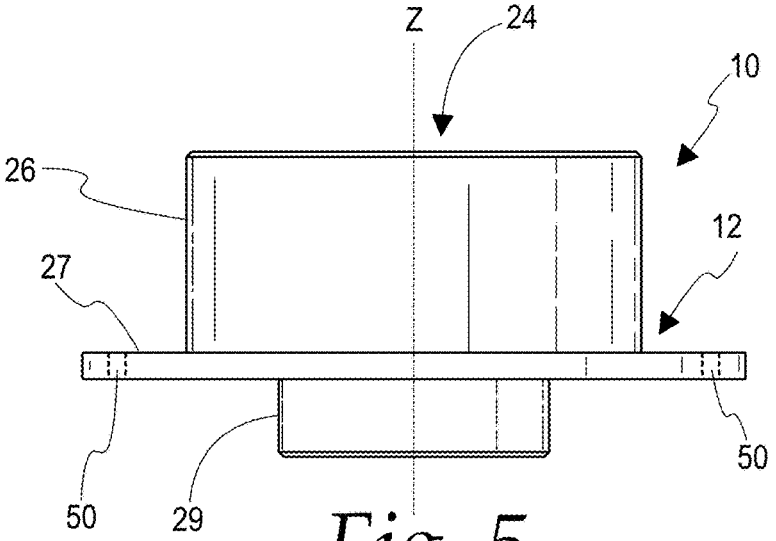
FIG. 5 is a lateral elevation view of the drain fitting of FIG. 1.

A person of ordinary skill in the art will appreciate that elements of the figures above are illustrated for simplicity and clarity and are not necessarily drawn to scale. The dimensions of some elements in the figures may have been exaggerated relative to other elements to help to understand the present teachings. Furthermore, a particular order in which certain elements, parts, components, modules, steps, actions, events and/or processes are described or illustrated may not be required. A person of ordinary skills in the art will appreciate that, for simplicity and clarity of illustration, some commonly known and well-understood elements that are useful and/or necessary in a commercially feasible embodiment may not be depicted to provide a clear view of various embodiments per the present teachings.

DETAILED DESCRIPTION

In the following description of various examples of embodiments of the disclosed device, reference is made to the accompanying drawings, which form a part hereof. Other specific arrangements of parts and environments can be used, and structural modifications and functional modifications can be made without departing from the scope of the disclosed device and methods.

As illustrated in the accompanying drawings and described herein, the present disclosure provides a one-piece floor drain fitting, including an integral mounting flange for fast and secure installation, for use as an open-site drain within a building.

Turning now to the drawings, shown in FIGS. 1-6B are various views of a drain fitting 10, 10' according to embodiments of the disclosure. In one embodiment, the drain fitting 10 comprises a drain body 12 of one-piece construction and a cover 14 that is a simple insertable plug-type cover. In another embodiment, the drain fitting 10' comprises the drain body 12 and a cover 14' that is a thin, breakable film affixed to an upper end of the drain body 12, such as by heat welding or the application of a suitable adhesive. The drain body 12 can be formed, for example, in one piece of suitable polymer such as molded PVC or molded CPVC, cast iron, or other suitable plumbing material. As best seen in the lateral cross-sectional elevation view of FIG. 6A, the drain body 12 has a top side 15, a top opening 16 on the top side 15, a bottom side 17 opposite the top side 15, a bottom opening 18 on the bottom side 17, an outer periphery 20, an inner periphery 22, a z-axis extending vertically through the top opening 16 and the bottom opening 18, and a peripherally enclosed flow channel 24 extending vertically from the top opening 16 to the bottom opening 18 and radially outwardly from the z-axis to the inner periphery 22.

The drain body 12 comprises a drain cup 26, a peripheral mounting flange 27, and a hub connection 29. The drain cup 26 comprises a cup sidewall 28 and a cup floor 30. The cup sidewall 28 extends circumferentially around the flow channel 24 and has an upper end 32 circumscribing the top opening 16, the cup floor 30 being connected to a lower end 34 of the cup sidewall 28. The cup floor 30 has an upper surface 31, the cup floor upper surface 31 extending circumferentially around an upper end of a central opening formed in the cup floor 30, and radially outwardly and vertically upwardly from the central opening to the cup sidewall 28. An average downward slope in a radially inward direction from an upper end to a lower end of the cup floor upper surface 31 can be, for example, in a range from 1:3 to 2:3. More particularly, the cup floor upper surface 31 is upwardly concave and serves to direct drainage toward a throat 36 that forms the central opening and extends downwardly through the cup floor 30. In other embodiments not shown, that slope can be continuous so that the cup floor upper surface is conical/frustoconical. The throat 36 thus fluidly connects an interior volume of the drain cup 26 below the top opening 16 to an interior volume of the hub connection 29 above the bottom opening 18.

The hub connection 29 comprises a hub sidewall 44 connected to a lower side 46 of the cup floor 30, the lower side 46 comprising a lower surface of the cup floor 30, which circumscribes a lower end of the throat 36 and extends radially outwardly from the throat 36 to the hub sidewall 44. The lower side 46 of the cup floor 30 serves as a stop for receiving an upper end of a drain pipe inserted into the hub connection 29. More particularly, an inner diameter of the throat 36 corresponds to an inner diameter of a drain pipe to be so inserted. The hub sidewall 44 extends circumferentially around the flow channel 24, a lower end 48 of the hub sidewall 44 circumscribing the bottom opening 18.

The mounting flange 27 is connected to and extends radially outwardly from and circumferentially around the cup sidewall 28. The mounting flange comprises a plurality of fastener holes 50 extending through a vertical thickness t of the mounting flange, which may for example be ⅛ inch to ⅜ inch, or more particularly ¼ inch. The mounting flange fastener holes 50 are spaced radially outwardly from the cup sidewall 28 and radially outwardly from the hub sidewall 44. As illustrated, the mounting flange 27 has the shape of an annular disk. More particularly, the mounting flange 27 comprises a planar lower surface 51, the mounting flange lower surface 51 being coplanar with that of the lower side 46 of the cup floor 30.

Accordingly, the flow channel 24 comprises a cup region 38, a throat region 40, and a hub region 42, the cup region 38 extending downwardly from the top opening 16 to the upper surface 31 of the cup floor 30 and the throat region 40, the throat region 40 extending downwardly from the cup region 38 to the hub region 42, the hub region 42 extending downwardly from the throat region 40, and from the lower side 46 of the cup floor 30, to the bottom opening 18. The flow channel cup region 38 extends to a first radius $R_1$ from the z-axis, the flow channel throat region 40 extending to a second radius $R_2$ from the z-axis, and the flow channel hub region 42 extends to a third radius $R_3$ from the z-axis. The second radius $R_2$ is smaller than the first radius $R_1$ and smaller than the third radius $R_3$. The drain cup 26 can have a pipe size (i.e., a nominal inner diameter), for example, ranging from 1½ inches to 6 inches. More particularly, the drain cup 26 can have a 3-inch or 4-inch pipe size, and can comprise a length of 3-inch or 4-inch Schedule 40 PVC pipe. The hub connection 29 can have a hub size (i.e., can fit a pipe of nominal inner diameter), for example, ranging from 1¼ inches to 3 inches. More particularly, the hub connection 29 can have a hub size of 1½ inches or 2 inches, and still more particularly can be a 1-½-inch or 2-inch Schedule 40 PVC hub, with a wall thickness of about 4 mm, corresponding to an inner diameter of the hub connection 29 of 1.900 inch or 2.375 inches, respectively.

Figure 6A:
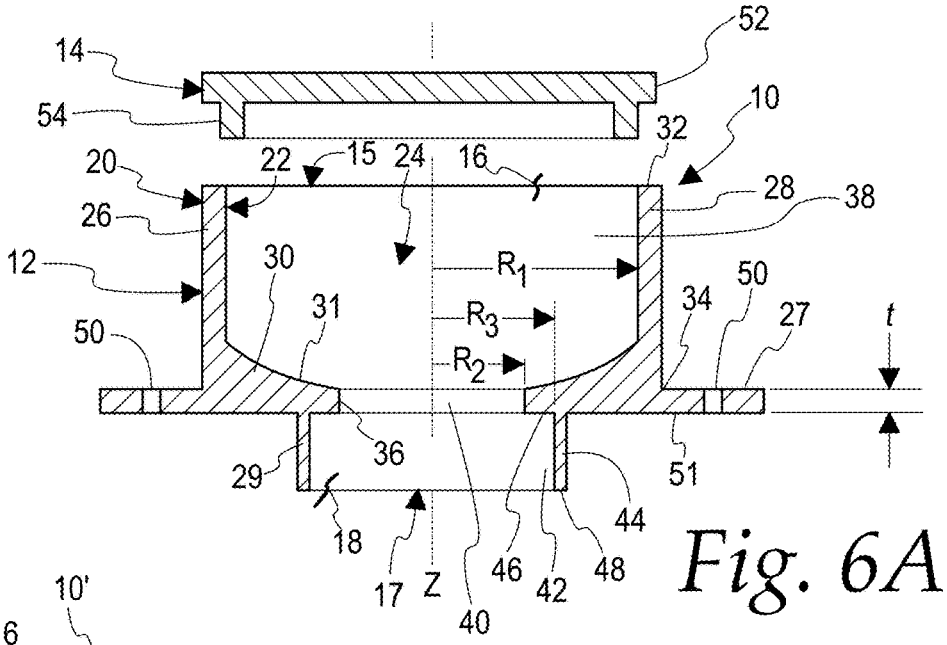
FIG. 6A is a cross-sectional lateral elevation view of the drain fitting of FIG. 1 including a cover according to an embodiment.
Figure 6B:
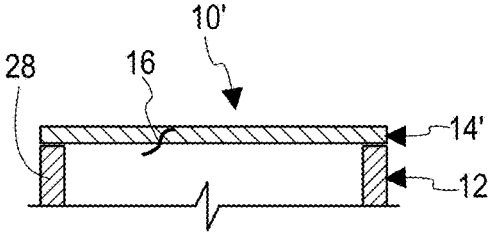
FIG. 6B is a truncated cross-sectional lateral elevation of the drain fitting of FIG. 1 including a cover according to another embodiment.

As mentioned above, in embodiments of the disclosure, the drain fitting 10, 10' further comprises a cover 14, 14'. As shown in FIGS. 6A and 6B, the cover 14, 14' is removably disposed over the upper end 32 of the cup sidewall 28 so as to cover the top opening 16 of the drain body 12. The cover 14, 14' serves to keep debris out of the drain fitting 10, 10', which can be used as an open-site drain within a building, during construction, and can then be removed. As illustrated in FIG. 6A, the cover 14 is a one-piece rigid body comprising a flat round disk 52 and a downward projection 54 connected to the bottom side of the disk 52, the downward projection 54 being operative to be removably inserted into the top opening 16 of the drain body 12 so that an outer periphery of the disk 52 overlaps an inner periphery of the upper end 32 of the cup sidewall 28. The disk 52 can thus simply rest on top of the upper end 32 of the cup sidewall 28, so that the cover 14 is removable simply by being lifted manually from the drain body 12. With reference to FIG. 6B, the film of the cover 14', which may for example be about 1/64 inch to about ⅛ inch thick, is affixed to the upper end 32 of the cup sidewall 28, such as by heat welding or a suitable adhesive as mentioned above, in such a manner that it can be manually peeled away. In an embodiment, such peeling can be facilitated by the cover 14' including a manually graspable tab (not shown) that extends outside the outer periphery of the cup sidewall 28. Alternatively, the film of the cover 14' can be punctured by a hand tool, such as a utility knife or screwdriver, to form a hole, to permit a user to tear the film from the hole to its outer edge and then grasp and peel away the outer edge of the film from the cup sidewall upper end 32.

Figure 7:
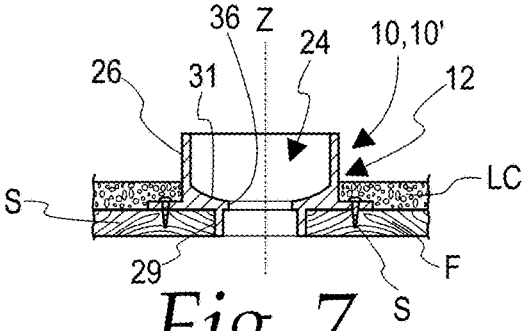
FIG. 7 is a cross-sectional elevation view of the drain fitting of FIG. 1 illustrating a method of installation according to an embodiment.
Figure 8:
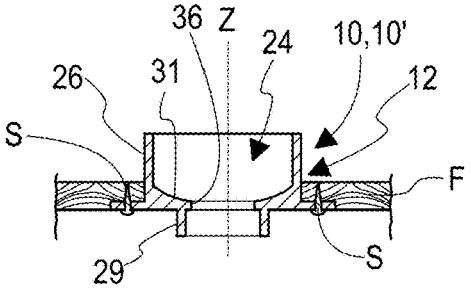
FIG. 8 is a cross-sectional elevation view of the drain fitting of FIG. 1 illustrating a method of installation according to another embodiment.

Four methods of installing the floor drain fitting 10, 10' are illustrated in FIGS. 7-10, respectively, where the cover 14, 14' is omitted (thus illustrating the drain fitting 10, 10' with the cover 14, 14' already removed after construction is completed) for ease of illustration. With reference to FIGS. 7 and 8, two methods are illustrated in which the mounting flange 27 is fastened by fasteners (illustrated as screws S) to a subfloor F, where the subfloor F can be made of wood or other suitable material for driving screws or nails. According to each method, the drain body 12 is positioned so that the mounting flange 27 is disposed against a surface of the subfloor F and so that the subfloor surface overlaps the fastener holes 50, and the fasteners (screws S) are driven vertically through the fastener holes 50 and into the subfloor F to fasten the mounting flange 27 to the subfloor F. In the method shown in FIG. 7, the mounting flange 27 is placed over the subfloor F so that the hub connection 29 extends downwardly through a hole formed in the subfloor F, the subfloor surface that overlaps the fastener holes 50 being an upper surface of the subfloor F, and the screws S are driven downwardly. A layer of gypsum concrete can then be formed or placed over the subfloor F and the mounting flange 27 of the drain fitting 10, 10'. In the method shown in FIG. 8, the drain body 12 is positioned so that the drain cup 26 extends upwardly through a hole formed in the subfloor F, the subfloor surface that overlaps the fastener holes 50 being a lower surface of the subfloor F, and the screws S are driven upwardly (that is, upwardly with respect to the installed orientation of the subfloor F).

Figure 9:
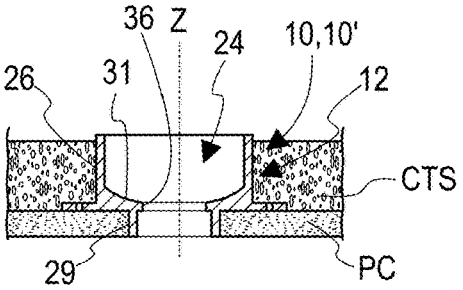
FIG. 9 is a cross-sectional elevation view of the drain fitting of FIG. 1 illustrating a method of installation according to another embodiment.
Figure 10:
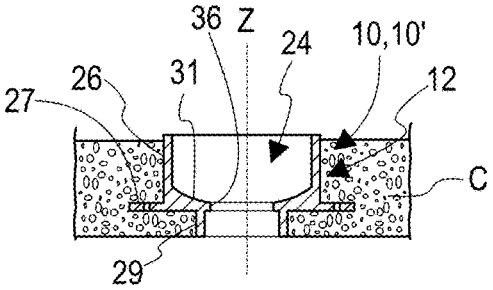
FIG. 10 is a cross-sectional elevation view of the drain fitting of FIG. 1 illustrating a method of installation according to another embodiment.

Turning to FIGS. 9 and 10, two more methods are illustrated of using the drain fitting 10, 10' in concrete-only floor installations. As illustrated in FIG. 9, the drain body 12 is positioned so that the hub connection 29 is inserted downwardly into a countersunk upper end of a hole in a precast concrete form PC, and the mounting flange 27 rests on top of the precast concrete form PC. A concrete topping slab CTS is then poured over the drain fitting 10, 10'. According to a fourth method shown in FIG. 10, a cast-in-place concrete slab is poured around the drain fitting 10, 10', such as by sliding the hub connection 29 onto the upper end of a drain pipe (not shown) sized to be received in the hub connection 29 until the upper end of the drain pipe meets the lower side 46, and then pouring concrete to fill the peripheral space around the drain pipe and the drain fitting 10, 10' up to a level above the mounting flange 27 and below the upper end of the drain cup 26. The mounting flange 27, while not attached to the concrete by fasteners in either of these methods, does not interfere with the installation process, while allowing the drain fitting 10, 10' to be held down in place by the concrete disposed over the mounting flange 27 in the installed position.

The preceding description of the disclosure has been presented for purposes of illustration and description and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this disclosure is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional disclosures are not dedicated to the public and the right to file one or more applications to claim such additional disclosures is reserved.

What is claimed is:

1. A drain fitting comprising:

a drain body of one-piece construction, the drain body having a top side, a top opening on the top side, a bottom side opposite the top side, a bottom opening on the bottom side, an outer periphery, an inner periphery, an axis extending vertically through the top opening and the bottom opening, and a peripherally enclosed flow channel extending vertically from the top opening to the bottom opening and radially outwardly from the axis to the inner periphery;

the drain body comprising:

a drain cup, the drain cup comprising a cup sidewall and a cup floor, the cup sidewall extending circumferentially around the flow channel and having an upper end circumscribing the top opening, the cup floor being connected to a lower end of the cup sidewall, the flow channel comprising a throat region extending vertically through the cup floor;

a hub connection, the hub connection comprising a hub sidewall connected to a bottom side of the cup floor, the hub sidewall extending circumferentially around the flow channel, a lower end of the hub sidewall circumscribing the bottom opening;

a peripheral mounting flange, the mounting flange being connected to and extending radially outwardly from and circumferentially around the cup sidewall, the mounting flange comprising at least one fastener hole extending through a vertical thickness of the mounting flange, the mounting flange fastener hole being spaced radially outwardly from the cup sidewall and radially outwardly from the hub sidewall;

a cover, the cover being removably disposed over an upper end of the cup sidewall so as to cover the top opening, the cover comprising a breakable film affixed to the upper end of the cup sidewall.

2. The drain fitting of claim 1 wherein the breakable film is affixed by one of welding and a suitable adhesive being applied between the breakable film and the upper end of the cup sidewall.

3. The drain fitting of claim 1 wherein the flow channel further comprises a cup region and a hub region, the cup region extending downwardly from the top opening to the cup floor and the throat region, the throat region extending downwardly from the cup region to the hub region, the hub region extending downwardly from the throat region to the bottom opening, the flow channel cup region extending to a first radius from the axis, the flow channel throat region extending to a second radius from the axis, and the flow channel hub region extending to a third radius from the axis, the second radius being smaller than the first radius and smaller than the third radius.

4. The drain fitting of claim 3 wherein the third radius is smaller than the first radius.

5. The drain fitting of claim 4 wherein the flow channel cup region comprises a cylindrical volume having a first diameter that is twice the first radius, the flow channel throat region comprises a cylindrical volume having a second diameter that is twice the second radius, and the flow channel hub region comprises a cylindrical volume having a third diameter that is twice the third radius.

6. The drain fitting of claim 5, further comprising the first diameter measuring in a range from 2½ inches to 5 inches and the third diameter measuring in a range from 1½ inch to 3 inches.

7. A drain fitting comprising:

a drain body of one-piece construction, the drain body having a top side, a top opening on the top side, a bottom side opposite the top side, a bottom opening on the bottom side, an outer periphery, an inner periphery, an axis extending vertically through the top opening and the bottom opening, and a peripherally enclosed flow channel extending vertically from the top opening to the bottom opening and radially outwardly from the axis to the inner periphery;

the drain body comprising:

a drain cup, the drain cup comprising a cup sidewall and a cup floor, the cup sidewall extending circumferentially around the flow channel and having an upper end circumscribing the top opening, the cup floor being connected to a lower end of the cup sidewall, the flow channel comprising a throat region extending vertically through the cup floor;

a hub connection, the hub connection comprising a hub sidewall connected to a bottom side of the cup floor, the hub sidewall extending circumferentially around the flow channel, a lower end of the hub sidewall circumscribing the bottom opening;

a peripheral mounting flange, the mounting flange being connected to and extending radially outwardly from and circumferentially around the cup sidewall, the mounting flange comprising at least one fastener hole extending through a vertical thickness of the mounting flange, the mounting flange fastener hole being spaced radially outwardly from the cup sidewall and radially outwardly from the hub sidewall;

each of the cup floor and the mounting flange having a planar lower surface, the cup floor lower surface being coplanar with the mounting flange lower surface.

8. The drain fitting of claim 7 wherein the drain body is formed of molded PVC.

9. The drain fitting of claim 7, further comprising a cover, the cover being removably disposed over an upper end of the cup sidewall so as to cover the top opening.

10. The drain fitting of claim 9 wherein the cover is a one-piece rigid body comprising a flat round disk and a downward projection connected to the bottom side of the disk, the downward projection being operative to be removably inserted into the top opening of the drain body so that an outer periphery of the disk overlaps an inner periphery of the upper end of the cup sidewall.

11. The drain fitting of claim 7 wherein the flow channel further comprises a cup region and a hub region, the cup region extending downwardly from the top opening to the cup floor and the throat region, the throat region extending downwardly from the cup region to the hub region, the hub region extending downwardly from the throat region to the bottom opening, the flow channel cup region extending to a first radius from the axis, the flow channel throat region extending to a second radius from the axis, and the flow channel hub region extending to a third radius from the axis, the second radius being smaller than the first radius and smaller than the third radius.

12. The drain fitting of claim 11 wherein the third radius is smaller than the first radius.

13. The drain fitting of claim 12 wherein the flow channel cup region comprises a cylindrical volume having a first diameter that is twice the first radius, the flow channel throat region comprises a cylindrical volume having a second diameter that is twice the second radius, and the flow channel hub region comprises a cylindrical volume having a third diameter that is twice the third radius.

14. The drain fitting of claim 13, further comprising the first diameter measuring in a range from 2½ inches to 5 inches and the third diameter measuring in a range from 1½ inch to 3 inches.

15. The drain fitting of claim 13 wherein the first diameter has a measurement selected from 3 inches and 4 inches and the second diameter has a measurement selected from 1.900 inch and 2.375 inches.

16. The drain fitting of claim 14 wherein the cup floor comprises an upper surface extending circumferentially around an upper end of the flow channel throat region and radially outwardly and vertically upwardly from the flow channel throat region to the cup sidewall.

17. The drain fitting of claim 16 wherein the cup floor upper surface is upwardly concave.

18. The drain fitting of claim 7 wherein the cup floor lower surface circumscribes a lower end of the flow channel throat region and extends radially outwardly from the flow channel throat region to the hub sidewall.

19. A method of installing a floor drain fitting, the floor drain fitting comprising a one-piece drain body having a top side, a top opening on the top side, a bottom side opposite the top side, a bottom opening on the bottom side, an outer periphery, an inner periphery, an axis extending vertically through the top opening and the bottom opening, and a peripherally enclosed flow channel extending vertically from the top opening to the bottom opening and radially outwardly from the axis to the inner periphery; the drain body comprising a drain cup, a hub connection, and a peripheral mounting flange, the drain cup circumscribing the top opening, the hub connection circumscribing the bottom opening, the mounting flange being connected to and extending radially outwardly from and circumferentially around the drain cup, the mounting flange comprising at least one fastener hole extending through a vertical thickness of the mounting flange, the mounting flange fastener hole being spaced radially outwardly from the drain cup and the hub connection, the method comprising:

positioning the drain body so that the drain cup extends upwardly through a hole formed in a subfloor, so that the mounting flange is disposed against a lower surface of the subfloor, and so that the subfloor lower surface overlaps the fastener holes; and driving the fasteners upwardly through the fastener holes and into the subfloor to fasten the mounting flange to the subfloor.

20. A method of installing a floor drain fitting, the floor drain fitting comprising a one-piece drain body having a top side, a top opening on the top side, a bottom side opposite the top side, a bottom opening on the bottom side, an outer periphery, an inner periphery, an axis extending vertically through the top opening and the bottom opening, and a peripherally enclosed flow channel extending vertically from the top opening to the bottom opening and radially outwardly from the axis to the inner periphery; the drain body comprising a drain cup, a hub connection, and a peripheral mounting flange, the drain cup circumscribing the top opening, the hub connection circumscribing the bottom opening, the mounting flange being connected to and extending radially outwardly from and circumferentially around the drain cup, the mounting flange comprising at least one fastener hole extending through a vertical thickness of the mounting flange, the mounting flange fastener hole being spaced radially outwardly from the drain cup and the hub connection, the method comprising:

positioning the drain body so that the hub connection extends downwardly through a hole formed in a subfloor, so that the mounting flange is disposed against an upper surface of the subfloor, and so that the upper subfloor surface overlaps the fastener holes, and driving the fasteners downwardly through the fastener holes and into the subfloor to fasten the mounting flange to the subfloor.

* * * * *